US008283284B2

(12) United States Patent
Hirai et al.

(10) Patent No.: US 8,283,284 B2
(45) Date of Patent: Oct. 9, 2012

(54) THERMOSENSITIVE RECORDING MEDIUM

(75) Inventors: Kenji Hirai, Tokyo (JP); Akihito Ogino, Tokyo (JP)

(73) Assignee: Nippon Paper Industries Co., Ltd., Tokyo (JP)

( * ) Notice: Subject to any disclaimer, the term of this patent is extended or adjusted under 35 U.S.C. 154(b) by 394 days.

(21) Appl. No.: 12/599,617

(22) PCT Filed: May 1, 2008

(86) PCT No.: PCT/JP2008/058329

§ 371 (c)(1),
(2), (4) Date: Nov. 10, 2009

(87) PCT Pub. No.: WO2008/139948

PCT Pub. Date: Nov. 20, 2008

(65) Prior Publication Data

US 2011/0105319 A1 May 5, 2011

(30) Foreign Application Priority Data

May 10, 2007 (JP) ..... 2007-125267

(51) Int. Cl.
*B41M 5/337* (2006.01)

(52) U.S. Cl. ..... 503/201; 503/215

(58) Field of Classification Search ..... None
See application file for complete search history.

(56) References Cited

U.S. PATENT DOCUMENTS

| | | | | |
|---|---|---|---|---|
| 4,032,690 | A | 6/1977 | Kohmura et al. | |
| 4,243,716 | A | 1/1981 | Kosaka et al. | |
| 4,265,978 | A | 5/1981 | Morishita et al. | |
| 6,037,308 | A | 3/2000 | Sato et al. | |
| 6,656,880 | B2 | 12/2003 | Aono | |
| 6,680,281 | B2 | 1/2004 | Tajiri et al. | |
| 7,618,922 | B2 * | 11/2009 | Ogino et al. | 503/226 |
| 8,129,307 | B2 | 3/2012 | Makihara et al. | |
| 2003/0045426 | A1 | 3/2003 | Ito | |
| 2004/0198603 | A1 | 10/2004 | Kawakami et al. | |
| 2004/0241598 | A1 | 12/2004 | Suga et al. | |
| 2005/0118526 | A1 | 6/2005 | Suga et al. | |
| 2006/0264326 | A1 | 11/2006 | Fisher et al. | |
| 2008/0139385 | A1 | 6/2008 | Ogino et al. | |
| 2008/0214786 | A1 | 9/2008 | Oyama | |
| 2010/0062935 | A1 | 3/2010 | Takagi et al. | |
| 2010/0099557 | A1 | 4/2010 | Makihara et al. | |
| 2010/0248959 | A1 | 9/2010 | Kato et al. | |
| 2011/0130281 | A1 | 6/2011 | Kurihara et al. | |
| 2011/0269622 | A1 | 11/2011 | Ohse et al. | |
| 2012/0038737 | A1 | 2/2012 | Hirai et al. | |

FOREIGN PATENT DOCUMENTS

| | | |
|---|---|---|
| EP | 0 465 665 | 1/1992 |
| EP | 0 764 635 | 3/1997 |
| EP | 0 779 539 | 6/1997 |
| EP | 1 116 713 | 7/2001 |
| EP | 1 199 185 | 4/2002 |
| EP | 1 367 437 | 12/2003 |
| EP | 1 437 231 | 7/2004 |
| EP | 1 747 898 | 1/2007 |
| EP | 1 808 304 | 7/2007 |
| EP | 2 072 274 | 6/2009 |
| EP | 2 145 771 | 1/2010 |
| GB | 2 187 297 | 9/1987 |
| JP | 53-091995 | 8/1978 |
| JP | 54-128349 | 10/1979 |
| JP | 57-165290 | 10/1982 |
| JP | 60-179190 | 9/1985 |
| JP | 60-179290 | 9/1985 |
| JP | 61-181680 | 8/1986 |
| JP | 61-291179 | 12/1986 |
| JP | 62-270383 | 11/1987 |
| JP | 1-196389 | 8/1989 |
| JP | 2-55188 | 2/1990 |
| JP | 03 047790 | 2/1991 |
| JP | 3-190786 | 8/1991 |
| JP | 3-205181 | 9/1991 |
| JP | 3-219993 | 9/1991 |
| JP | H04-164687 | 6/1992 |
| JP | 05-139033 | 6/1993 |
| JP | 5-162443 | 6/1993 |
| JP | 5-221115 | 8/1993 |
| JP | H06-155916 | 6/1994 |
| JP | 6-234275 | 8/1994 |
| JP | 6-262853 | 9/1994 |
| JP | H06-270547 | 9/1994 |

(Continued)

OTHER PUBLICATIONS

Notification of Transmittal of Translation of International Preliminary Report on Patentability corresponding to International Application No. PCT/JP2008/054719 dated Oct. 29, 2009.
European Search Report corresponding to European Patent Application No. 09725687.9-2304 dated Feb. 24, 2012.
Extended European Search Report corresponding to European Patent Application No. 08827733.0-2304 dated Jan. 27, 2012.
Extended European Search Report corresponding to European Patent Application No. 10756006.2-2304 dated Apr. 11, 2012.
International Search Report corresponding to International Patent Application No. PCT/JP2007/074385 dated Feb. 14, 2008.
International Search Report corresponding to International Patent Application No. PCT/JP2008/051100 dated Apr. 15, 2008.
International Search Report corresponding to International Patent Application No. PCT/JP2008/054719 dated Sep. 22, 2008.

(Continued)

*Primary Examiner* — Bruce H Hess
(74) *Attorney, Agent, or Firm* — Jenkins, Wilson, Taylor & Hunt, P.A.

(57) ABSTRACT

The present invention presents a thermosensitive recording medium having an excellent color developing property, water resistance and preservation properties (such as anti-self-color-development) and is harmless to the environment. The present invention is a thermosensitive recording medium having a thermosensitive recording layer comprising a colorless or pale colored basic leuco dye and an electron accepting developing agent on a substrate, wherein the thermosensitive recording layer further comprises a resin containing a carboxyl group, an epichlorohydrin resin and a polyamine/amide resin. This thermosensitive recording medium is suitable for recording with a low applied energy.

5 Claims, No Drawings

FOREIGN PATENT DOCUMENTS

| | | |
|---|---|---|
| JP | H06-286308 | 10/1994 |
| JP | 6-340171 | 12/1994 |
| JP | 7149713 | 6/1995 |
| JP | 07-179041 | 7/1995 |
| JP | H07-266711 | 10/1995 |
| JP | 07-314896 | 12/1995 |
| JP | H08-059603 | 3/1996 |
| JP | 08-207443 | 8/1996 |
| JP | 08-324123 | 12/1996 |
| JP | H08-333329 | 12/1996 |
| JP | H09-142018 | 6/1997 |
| JP | H09-207435 | 8/1997 |
| JP | H09-263047 | 10/1997 |
| JP | H10-250232 | 9/1998 |
| JP | H10-258577 | 9/1998 |
| JP | 10-272839 | 10/1998 |
| JP | H10-297089 | 11/1998 |
| JP | H10-297090 | 11/1998 |
| JP | 10-324062 | 12/1998 |
| JP | 10-324064 | 12/1998 |
| JP | 11-314454 | 11/1999 |
| JP | 2000-143611 | 5/2000 |
| JP | 2000-168242 | 6/2000 |
| JP | 2000-177243 | 6/2000 |
| JP | 3058758 | 7/2000 |
| JP | 2000-289333 | 10/2000 |
| JP | 2001-287459 | 10/2001 |
| JP | 2001-322358 | 11/2001 |
| JP | 2001-323095 | 11/2001 |
| JP | 2002-011954 | 1/2002 |
| JP | 2002-019300 | 1/2002 |
| JP | 2002-103789 | 4/2002 |
| JP | 2002-240430 | 8/2002 |
| JP | 2002-264538 | 9/2002 |
| JP | 2002-293023 | 10/2002 |
| JP | 2002-301873 | 10/2002 |
| JP | 2002-341770 | 11/2002 |
| JP | 2003-019861 | 1/2003 |
| JP | 2003-154760 | 5/2003 |
| JP | 2003-212841 | 7/2003 |
| JP | 3439560 | 8/2003 |
| JP | 2003-313795 | 11/2003 |
| JP | 2004-202913 | 7/2004 |
| JP | 2005-001281 | 1/2005 |
| JP | 2005-041013 | 2/2005 |
| JP | 2005-199554 | 7/2005 |
| JP | 2005-262549 | 9/2005 |
| JP | 3716736 | 11/2005 |
| JP | 2006-069032 | 3/2006 |
| JP | 3750786 | 3/2006 |
| JP | 2006-095852 | 4/2006 |
| JP | 3790648 | 6/2006 |
| JP | 2006-175835 | 7/2006 |
| JP | 2006-264255 | 10/2006 |
| JP | 2006-281472 | 10/2006 |
| JP | 2007-196616 | 8/2007 |
| JP | 3971453 | 9/2007 |
| JP | 2008-012879 | 1/2008 |
| JP | 2008-018619 | 1/2008 |
| JP | 2008-044226 | 2/2008 |
| JP | 2008-044227 | 2/2008 |
| JP | 2006-205561 | 8/2008 |
| JP | 2008-105222 | 8/2008 |
| JP | 2008-194918 | 8/2008 |
| WO | WO93/06074 | 4/1993 |
| WO | WO95/33714 | 12/1995 |
| WO | WO97/16420 | 5/1997 |
| WO | WO00/14058 | 3/2000 |
| WO | WO01/25193 | 4/2001 |
| WO | WO02/081229 | 10/2002 |
| WO | WO02/098674 | 12/2002 |
| WO | WO03/029017 | 4/2003 |
| WO | WO2004/002748 | 1/2004 |
| WO | WO2005/087503 | 9/2005 |
| WO | WO2005/087504 | 9/2005 |
| WO | WO2005/102725 | 11/2005 |
| WO | WO2006/075467 | 7/2006 |
| WO | WO2007/049621 | 5/2007 |
| WO | WO2008/099658 | 8/2008 |
| WO | WO2008/126635 | 10/2008 |
| WO | WO2008/139948 | 11/2008 |
| WO | WO2009/025316 | 2/2009 |
| WO | WO2009/028118 | 3/2009 |
| WO | WO2009/119813 | 10/2009 |
| WO | WO2010/110209 | 9/2010 |
| WO | WO2010/140662 | 12/2010 |

OTHER PUBLICATIONS

International Search Report corresponding to International Patent Application No. PCT/JP2008/058329 dated Jun. 9, 2008.

International Search Report corresponding to International Patent Application No. PCT/JP2008/064904 dated Oct. 7, 2008.

International Search Report corresponding to International Patent Application No. PCT/JP2009/056306 dated May 19, 2009.

International Search Report corresponding to International Patent Application No. PCT/JP2010/054818 dated Apr. 13, 2010.

International Search Report corresponding to International Patent Application No. PCT/JP2010/059462 dated Aug. 17, 2010.

Isogai et al., "Effects of Carboxyl Groups in Pulp on Retention of Alkylketene Dimer," Journal of Pulp and Paper Science. vol. 23, No. 5 pp. J215-J219 (1997).

Japanese Industrial Standard (JIS) P-8148. Paper, board and pulps—Measurement of diffuse blue reflectance factor (ISO brightness). Japanese Standards Association (2001).

Notice of Allowance corresponding to U.S. Appl. No. 12/520,514 dated Oct. 26, 2011.

Notice of Allowance corresponding to U.S. Appl. No. 12/593,116 dated May 15, 2012.

Notification Concerning Transmittal of International Preliminary Report on Patentability (Chapter I of the Patent Cooperation Treaty) corresponding to International Patent Application No. PCT/JP2009/056306 dated Oct. 7, 2010.

Notification Concerning Transmittal of International Preliminary Report on Patentability (Chapter I of the Patent Cooperation Treaty) corresponding to International Patent Application No. PCT/JP2010/054818 dated Sep. 24, 2011.

Notification of Transmittal of Translation of the International Preliminary Report on Patentability (Chapter I or Chapter II of the Patent Cooperation Treaty) corresponding to International Patent Application No. PCT/JP2007/074385 dated Mar. 18, 2010.

Notification of Transmittal of Translation of the International Preliminary Report on Patentability (Chapter I or Chapter II of the Patent Cooperation Treaty) corresponding to International Application No. PCT/JP2008/051100 dated Aug. 27, 2009.

Notification of Transmittal of Translation of the International Preliminary Report on Patentability (Chapter I or Chapter II of the Patent Cooperation Treaty) corresponding to International Patent Application No. PCT/JP2008/058329 dated Jan. 21, 2010.

Notification of Transmittal of Translation of the International Preliminary Report on Patentability (Chapter I or Chapter II of the Patent Cooperation Treaty) corresponding to International Patent Application No. PCT/JP2008/064904 dated Mar. 18, 2010.

Notification of Transmittal of Translation of the International Preliminary Report on Patentability (Chapter I or Chapter II of the Patent Cooperation Treaty) corresponding to International Patent Application No. PCT/JP2009/056306 dated Nov. 18, 2010.

Notification of Transmittal of Translation of the International Preliminary Report on Patentability (Chapter I or Chapter II of the Patent Cooperation Treaty) corresponding to International Patent Application No. PCT/JP2010/054818 dated Jan. 12, 2012.

Notification of Transmittal of Translation of the International Preliminary Report on Patentability (Chapter I or Chapter II of the Patent Cooperation Treaty) corresponding to International Patent Application No. PCT/JP2010/059462 dated Dec. 15, 2011.

Official Action corresponding to U.S. Appl. No. 12/520,514 dated Mar. 10, 2010.

Official Action corresponding to U.S. Appl. No. 12/520,514 dated Oct. 27, 2010.

Official Action corresponding to U.S. Appl. No. 12/593,116 dated Feb. 1, 2012.

Supplementary European Search Report corresponding to European Patent Application No. 08703912.9-1251/2112001 dated Jan. 22, 2010.
Supplementary European Search Report corresponding to European Patent Application No. 08722115.6-1251/2130681 dated Mar. 5, 2010.
Translation, "Explanation for filing a request for early examination," filed in the corresponding JP application (2007-282831) on Feb. 10, 2009.
Translation, "Opinion," filed in the corresponding JP application (2007-282831) on Mar. 24, 2009 in response to an office action of Mar. 9, 2009.
Translation, "Test Report," filed in the corresponding JP application (2007-282831) on Feb. 10, 2009.
Notice of Opposition corresponding to European Patent Application No. 08 752 259.5-1251/2145771 dated Jun. 14, 2012.

* cited by examiner

THERMOSENSITIVE RECORDING MEDIUM

FIELD OF THE INVENTION

The present invention relates to a thermosensitive recording medium for recording image by utilizing a color formation reaction between a basic leuco dye and an electron accepting color developing agent and more particularly to a thermosensitive recording medium having a superior color development sensitivity even when the recording medium is recorded with a low applied energy, such as in the case of a handy terminal paper and a delivery receipt.

BACKGROUND OF THE INVENTION

A thermosensitive recording medium develops color by reacting a colorless or pale colored basic leuco dye (henceforth referred to as "dye") and an electron accepting color developing agent (henceforth referred to as "color developing agent") when heated and is widely used. In general, a thermal printer equipped with a thermal head is used to record on the thermosensitive recording medium. This recording method has many advantages, such as maintenance free, inexpensive, compact in size, clear color development, etc., therefore is used extensively in facsimiles, printers of computers, automatic ticket vending machines, measurement recorders, handy terminals and the like.

The thermosensitive recording medium used for handy terminals and the like that are mainly used in outdoors is required to be water resistant. The thermosensitive recording medium is also required to have a good color development sensitivity when recorded or forming an image even in a low applied energy by using an energy-saving printer, a high-speed printer and the like.

On the other hand, it is commonly conducted to install a protecting layer (overcoat layer) containing a binder, such as polyvinyl alcohol, on a thermosensitive recording layer in order to improve water resistance of a thermosensitive recording medium. It is well known that a thermosensitive recording medium shows an excellent water resistance and printing run-ability when installing a protecting layer (overcoat layer) comprising a resin containing a carboxyl group, an epichlorohydrin resin and a polyamine/amide resin (Reference 1).

However, when a protecting layer is installed on a thermosensitive recording layer, the heat of a thermal head can not well conducted to the thermosensitive recording layer, which results in a poor color development sensitivity especially when recording in a low applied energy.

In order to address this problem, it is often conducted to make the thermosensitive recording layer contain a carboxyl modified polyvinyl alcohol (References 2, 3) or a combination of a carboxyl modified polyvinyl alcohol and a glyoxal (Reference 4) as a binder without installing a protecting layer.

However, it has been considered problematic to use a resin containing a carboxyl group and a glyoxal, since a resin containing a carboxyl group has a disadvantage of desensitization and a glyoxal is classified as PRTR (Pollutant Release and Transfer Register) Type 1 material which is harmful to the environment.

Reference 1: International Publication W02006/075467
Reference 2: Japanese Patent No. 3501308
Reference 3: Japanese Patent Application Public Disclosure H06-155916
Reference 4: Japanese Patent Application Public Disclosure H06-270547

Problems to be Solved by the Invention

Improved color development sensitivity, improved film performance such as water resistance without installing a protective layer and the lack of an adverse environmental impact are sought for a thermosensitive recording medium. Therefore, the objective of the present invention is to present a thermosensitive recording medium with excellent color development sensitivity, water resistance, plasticizer resistance and storage stability (resistance for background coloring) that has low environmental impact.

Means to Solve the Problems

The inventors discovered that the problem described above could be resolved by having a resin containing carboxyl group, an epichlorohydrin resin and a polyamine/amide resin in the thermosensitive recording layer, and the present invention was completed based on the discovery. A thermosensitive recording medium on which the thermosensitive recording layer had been installed was found to have particularly outstanding responsiveness even when it was printed using low applied energy.

That is, the present invention is a thermosensitive recording medium having a thermosensitive recording layer comprising a colorless or pale colored basic leuco dye and an electron accepting developing agent on a substrate, wherein the thermosensitive recording layer further comprises a resin containing a carboxyl group, an epichlorohydrin resin and a polyamine/amide resin.

The present invention is also the thermosensitive recording medium, wherein the thermosensitive recording medium is recorded with a applied energy of 0.1 to 0.3 mJ/dot.

Furthermore, the present invention is a method for preparing a recorded thermosensitive recording medium comprising recording the thermosensitive recording medium with a applied energy of 0.1 to 0.3 mJ/dot.

Advantages of the Invention

According to the present invention, a thermosensitive recording medium with excellent color development sensitivity, water resistance and storage stability (resistance for background coloring) and gentle environmental impact can be obtained.

The thermosensitive recording medium of the present invention has particularly an excellent color development sensitivity even when low applied energy printing is executed using a handy terminal printer and the like.

In addition, the thermosensitive recording medium of the present invention has a film performance equivalent to that of a thermosensitive recording medium containing a protective layer (Reference 1) and can be printed equally well using low applied energy. Therefore, the thermosensitive recording medium enables the printer power consumption to be reduced. The merit of the thermosensitive recording medium of the present invention is greater, particularly when a battery operated handy terminal printer and the like are used, since the operating time of such a printer can be extended.

DETAILED DESCRIPTION OF THE INVENTION

The mechanism described below is thought to allow the thermosensitive recording medium having the constitution of the present invention to deliver excellent effects.

Water resistance in the thermosensitive recording layer of the thermosensitive recording medium of the present invention is realized through a crosslinking reaction between the carboxyl group of the resin containing carboxyl group and the amine or the amide segment of the epichlorohydrin resin that act as the crosslinking agent. Next, the hydrophilic segments of the polyamine/amide resin and the hydrophilic crosslinked segments formed by the resin containing carboxyl group and the epichlorohydrin resin associate by attraction and the crosslinked segment is encased by the polyamine/amide resin with the hydrophobic group on the outside. That is, the hydrophilic crosslinked segment is protected from water by the hydrophobic groups to yield additional water resistance.

The hydrophilic segment of a polyamine/polyamide resin is particularly attracted to the hydroxyl group of the resin containing carboxyl group when a resin containing carboxyl group contains hydroxyl groups such as, for example, in a carboxyl modified poly(vinyl alcohol), and the resin containing carboxyl group is encased in the polyamine/amide resin with the hydrophobic group on the outside. Furthermore, one type of crosslinking reaction is also thought to contribute to excellent water resistance, the reaction of which occurs between the cationic segment of the polyamine/amide resin and the carboxyl group of the resin containing carboxyl group.

In addition, acidic substances such as glyoxal, an epichlorohydrin resin and the like present in a thermosensitive recording layer sometimes interfere with the reaction between a dye and a color developing agent. The presence of an acidic substance in a thermosensitive recording layer causes problems such as inability to achieve sufficient color development sensitivity in low applied energy printing and a background coloring when stored for a long time. However, when an epichlorohydrin resin and a polyamine/amide resin are added as in the present invention, the epichlorohydrin resin is in a state wherein it is encapsulated by a polyamine/amide resin as explained above, and the influence of the epichlorohydrin resin on a dye or a color developing agent is decreased. This effect yields excellent storage stability and color development sensitivity.

Furthermore, the thermosensitive recording layer of the thermosensitive recording medium of the present invention is thought to be a more porous layer than that of conventional technology due to the presence of a more three dimensional structure created by the crosslinking reaction between a resin containing carboxyl group and an epichlorohydrin resin and the dispersion effect of the cationic polyamino/amide type resin on the anionic pigment formulated into the thermosensitive recording layer. For this reason, a molten material with low heat resistance that is generated in the coating layer under high temperature conditions is adsorbed by the gaps in the protective layer, and excellent printing run-ability (less head debris) is realized.

In addition, a resin containing carboxyl group has a desensitizing action, but the action is thought to be eliminated by the crosslinking reaction between the resin containing carboxyl group and the epichlorohydrin resin.

As the resin containing carboxyl group used in the thermosensitive recording layer of the present invention, resins containing mono-functional, carboxyl group containing acrylic monomers such as methacrylic acid, 2-hydroxyethyl methacrylate, 2-hydroxypropyl methacrylate, dimethyl aminoethyl methacrylate, glycidyl methacrylate, tetrahydrofurfuryl methacrylate and the like; oxidized starch, carboxymethyl cellulose, carboxy modified poly(vinyl alcohol) obtained by introducing carboxyl groups to poly(vinyl alcohol) and the like may be listed as examples. However, the use of carboxy modified poly(vinyl alcohol) with excellent heat resistance and plasticizer resistance is particularly preferred.

The carboxy modified poly(vinyl alcohol) used in the present invention may be obtained in the form of a reaction product of poly(vinyl alcohol) and a polyvalent carboxylic acid such as fumaric acid, phthalic anhydride mellitic anhydride, itaconic anhydride and the like or as esterified materials of these reaction products or, furthermore, in the form of saponified materials of the copolymers of vinyl acetate with an ethylenic unsaturated dicarboxylic acid such as maleic acid, fumaric acid, itaconic acid, crotonic acid, acrylic acid, methacrylic acid and the like. More specifically, the production processes listed as examples in Example 1 or Example 4 in, for example, Japanese Patent Application Public Disclosure S53-91995 may be cited. In addition, a degree of saponification of from 72 to 100 mole % is preferred for the carboxyl modified poly(vinyl alcohol). A degree of polymerization is preferably from 500 to 2400, more preferably 1000 to 2000.

The binders listed below may be used to the extent that the binder does not interfere with the desired performance. That is, completely saponified poly(vinyl alcohol) with a degree of polymerization of from 200 to 1900, partially saponified poly (vinyl alcohol), acetoacetylated poly(vinyl alcohol), carboxy modified poly(vinyl alcohol), amide modified poly(vinyl alcohol), sulfonic acid modified poly(vinyl alcohol), butyral modified poly(vinyl alcohol), olefin modified poly(vinyl alcohol), nitrile modified poly(vinyl alcohol), pyrolidone modified poly(vinyl alcohol), silicone modified poly(vinyl alcohol), other modified poly(vinyl alcohol)s, hydroxyethyl cellulose, methyl cellulose, ethyl cellulose, carboxymethyl cellulose, styrene-maleic anhydride copolymers, styrene-butadiene copolymers, cellulose derivatives such as ethyl cellulose and acetyl cellulose, casein, gum Arabic, oxidized starch, etherized starch, dialdehyde starch, esterified starch, poly(vinyl chloride), poly(vinyl acetate), polyacrylamide, poly(acrylate esters), poly(vinyl butyral), polystyrols and their copolymers, polyamide resins, silicone resins, petroleum resins, terpene resins, ketone resins, cumaro resins and the like may be listed as examples. The polymeric substances are used upon dissolving them in a solvent such as water, alcohol, ketones, esters, hydrocarbons and the like or dispersing them in water or other media to form an emulsion or a paste and may be combined depending upon the qualities required.

As specific examples of the epichlorohydrin resins that can be used in the present invention, poly(amide epichlorohydrin) resins, poly(amine epichlorohydrin) resins and the like may be cited and they can be used individually or in combinations. In addition, primary to quaternary amines may be used as the amine that is present in the main chain of an epichlorohydrin resin, and no particular restrictions apply. Furthermore, a degree of cationization of no greater than 5 meq/g-solid (measured at pH 7) and a molecular weight of at least 500,000 are preferred for the degree of cationization and the molecular weight based on good water resistance. Sumirez Resin 650 (30), Sumirez Resin 675A, Sumirez Resin 6615 (the above, Sumitomo Kagaku K.K.), WS4002, WS 4020, WS4024, WS4030, WS4046, WS4010, CP8970 (the above, Seiko PMC K.K.) may be cited as specific examples.

The polyamine/amide resin includes polyamide urea resins, polyalkylene polyamine resins, polyalkylene polyamide resins, polyamine polyurea resins, modified polyamine resins, modified polyamide resins, polyalkylene polyamine urea formalin resins, and polyalkylene polyamine polyamide polyurea resins. Specific examples include Sumirez resin 302 (polyamine polyurea resin produced by Sumitomo Chemical Co., Ltd.), Sumirez resin 712 (polyamine polyurea resin produced by Sumitomo Chemical Co., Ltd.), Sumirez resin 703 (polyamine polyurea resin produced by Sumitomo Chemical Co., Ltd.), Sumirez resin 636 (polyamine polyurea resin produced by Sumitomo Chemical Co., Ltd.), Sumirez resin SPI-100 (modified polyamine resin produced by Sumitomo Chemical Co., Ltd.), Sumirez resin SPI-102A (modified polyamine resin produced by Sumitomo Chemical Co., Ltd.), Sumirez resin SPI-106N (modified polyamide resin produced by Sumitomo Chemical Co., Ltd.), Sumirez resin SPI-203 (50)(Sumitomo Chemical Co., Ltd.), Sumirez resin SPI-198 (Sumitomo Chemical Co., Ltd.), PrintiveA-700 (Asahi Kasei Corporation), PrintiveA-600 (Asahi Kasei Corporation), PA6500, PA6504, PA6634, PA6638, PA6640, PA6644, PS6646, PA6654, PA6702, PA 6704 (the above, polyalkylene polyamine polyamide polyurea resins produced by Seiko PMC), and CP8994 (polyethylene imine resin produced by Seiko PMC) without any restriction, and they can be used solely or in combinations of two kinds or more. From the viewpoint of recording sensitivity, polyamine resins (polyalkylene polyamine resins, polyamine polyurea resins, modified polyamine resins, polyalkylene polyamine urea formalin resins, and polyalkylene polyamine polyamide polyurea resins) are preferable.

The amount of resin containing carboxyl groups added is preferably from 1 to 80 weight parts, more preferably from 10 to 60 weight parts per 100 weight parts of the pigment in a thermosensitive recording layer. The coating layer strength and water resistance are inadequate when the amount added is too little, and sensitivity reduction tends to occur when too much is added.

The concentration of either the epichlorohydrin resin and the polyamine/amide resin used in the present invention is preferably from 1 to 100 weight parts, more preferably from 5 to 50 weight parts per 100 weight parts of the resin containing carboxyl group. When the concentration is too low, the extent of the crosslinking reaction is inadequate and good water resistance cannot be achieved. When the concentration is too high, increased coating solution viscosity and gel formation cause operational problems.

Furthermore, the addition of a polyamine/amide resin and an epichlorohydrin resin in that order to a resin containing carboxyl group or the addition of a blended polyamine/amide resin when preparing a thermosensitive recording layer coating is preferred from the standpoint of coating stability.

All of the dyes well known in the conventional field of pressure sensitive and thermosensitive recording media may be used as the electron donating leuco dye in the present invention. Although the dye is not particularly restricted, triphenylmethane type compounds, fluorane type compounds, fluorene type compounds, divinyl type compounds and the like are preferred. Specific examples of the typical colorless to pale colored basic colorless dye (dye precursors) are shown below. In addition, these dye precursors may be used individually and also in mixtures of at least two of them.

<Triphenylmethane Type Leuco Dyes>

3,3-bis(p-Dimethyl aminophenyl)-6-dimethylaminophthalide [alternate name: crystal violet lactone] and 3,3-bis(p-Dimethyl aminophenyl) phthalide [alternate name: malachite green lactone]

<Fluorane Type Leuco Dyes>

3-Diethylamino-6-methylfluorane, 3-diethylamino-6-methyl-7-anilinofluorane, 3-diethylamino-6-methyl-7-(o,p-dimethylanilino)fluorane, 3-diethylamino-6-methyl-7-chlorofluoran, 3-diethylamino-6-methyl-7-(m-trifluoromethylanilino) fluorane, 3-diethylamino-6-methyl-7-(o-chloroanilino) fluorane, 3-diethylamino-6-methyl-7-(p-chloroanilino)fluorane, 3-diethylamino-6-methyl-7-(o-fluoroanilino)fluorane, 3-diethylamino-6-methyl-7-(m-methylanilino)fluorane, 3-diethylamino-6-methyl-7-n-octylanilino fluorane, 3-diethylamino-6-methyl-7-n-octylamino fluorane, 3-diethylamino-6-methyl-7-benzylamino fluorane, 3-diethylamino-6-methyl-7-dibenzylamino fluorane, 3-diethylamino-6-chloro-7-methyl fluorane, 3-diethylamino-6-chloro-7-anilino fluorane, 3-diethylamino-6-chloro-7-p-methylanilino fluorane, 3-diethylamino-6-ethoxyethyl-7-anilino fluorane, 3-diethylamino-7-methyl fluorane, 3-diethylamino-7-chloro fluorane, 3-diethylamino-7-(m-trifluoromethylanilino) fluorane, 3-diethylamino-7-(o-chloroanilino) fluorane, 3-diethylamino-7-(p-chloroanilino) fluorane, 3-diethylamino-7-(o-fluoroanilino) fluorane, 3-diethylamino-benz[a]fluorane, 3-diethylamino-benz[c] fluorane, 3-dibutylamino-6-methyl-fluorane, 3-dibutylamino-6-methyl-7-anilino fluorane, 3-dibutylamino-6-methyl-7-(o,p-dimethylanilino)fluorane, 3-dibutylamino-7-(o-chloroanilino)fluorane, 3-butylamino-6-methyl-7-(p-chloroanilino) fluorane, 3-dibutylamino-6-methyl-7-(o-fluoroanilino) fluorane, 3-dibutylamino-6-methyl-7-(m-fluoroanilino)fluorane, 3-dibutylamino-6-methyl-chloro fluorane, 3-dibutylamino-6-ethoxyethyl-7-anilino fluorane, 3-dibutylamino-6-chloro-7-anilino fluorane, 3-dibutylamino-6-methyl-7-p-methylanilino fluorane, 3-dibutylamino-7-(o-chloroanilino) fluorane, 3-dibutylamino-7-(o-fluoroanilino)fluorane, 3-di-n-pentylamino-6-methyl-7-anilino fluorane, 3-di-n-pentylamino-6-methyl-7-(p-chloroanilino) fluorane, 3-di-n-pentylamino-7-(m-trifluoromethylanilino)fluorane, 3-di-n-pentylamino-6-chloro-7-anilino fluorane, 3-di-n-pentylamino-7-(p-chloroanilino) fluorane, 3-pyrrolidino-6-methyl-7-anilino fluorane, 3-piperidino-6-methyl-7-anilino fluorane, 3-(N-methyl-N-propylamino)-6-methyl-7-anilino fluorane, 3-(N-methyl-N-cyclohexylamino)-6-methyl-7-anilino fluorane, 3-(N-ethyl-N-cyclohexylamino)-6-methyl-7-anilino fluorane, 3-(N-ethyl-N-xylylamino)-6-methyl-7-(p-chloroanilino)fluorane, 3-(N-ethyl-p-toluidino)-6-methyl-7-anilino fluorane, 3-(N-ethyl-N-isoamylamino)-6-methyl-7-anilino fluorane, 3-(N-ethyl-N-isoamylamino)-6-chloro-7-anilino fluorane, 3-(N-ethyl-N-tetrahydrofurfurylamino)-6-methyl-7-anilino fluorane, 3-(N-ethyl-N-isobutylamino)-6-methyl-7-anilino fluorane, 3-(N-ethyl-N-ethoxypropylamino)-6-methyl-7-anilino fluorane, 3-cyclohexylamino-6-chloro fluorane, 2-(4-oxahexyl)-3-dimethylamino-6-methyl-7-anilino fluorane, 2-(4-oxahexyl)-3-diethylamino-6-methyl-7-anilino fluorane, 2-(4-oxahexyl)-3-dipropylamino-6-methyl-7-anilino fluorane, 2-methyl-6-o-(p-dimethylaminophenyl)aminoanilino fluorane, 2-methoxy-6-p-(p-dimethylaminophenyl)aminoanilino fluorane, 2-chloro-3-methyl-6-p-(p-phenylaminophenyl)aminoanilino fluorane, 2-chloro-6-p-(p-dimethylaminophenyl)aminoanilino fluorane, 2-nitro-6-p-(p-diethylaminophenyl)aminoanilino fluorane, 2-amino-6-p-(p-diethylaminophenyl)aminoanilino fluorane, 2-diethylamino-6-p-(p-diethylaminophenyl)aminoanilino fluorane, 2-phenyl-6-methyl-6-p-(p-phenylaminophenyl)aminoanilino fluorane, 2-benzyl-6-p-(p-phenylaminophenyl)aminoanilino fluorane, 2-hydroxy-6-p-(p-phenylaminophenyl)aminoanilino fluorane, 3-methyl-6-p-(p-dimethylaminophenyl)aminoanilino fluorane, 3-diethylamino-6-p-(p-diethylaminophenyl)aminoanilino fluorane, 3-diethylamino-6-p-(p-dibutylaminophenyl)aminoanilino fluorane and 2,4-dimethyl-6-[(4-dimethylamino) anilino]fluorane.

<Fluorene Type Leuco Dye>

3,6,6-Tris(dimethylamino) spiro[fluorane-9,3'-phthalide] and 3,6,6'-tris(diethylamino) spiro[fluorane-9,3'-phthalide].

<Divinyl Type Leuco Dyes>

3,3-bis-[2-(p-Dimethylaminophenyl)-2-(p-methoxyphenyl)ethenyl]-4,5,6,7-tetrabromophthalide, 3,3-bis-[2-(p-dimethylaminophenyl)-2-(p-methoxyphenyl)ethenyl]-4,5,6,7-tetrachlorophthalide, 3,3-bis-[1,1-bis(4-pyrrolidinophenyl)ethylene-2-yl]-4,5,6,7-etrabromophthalide and 3,3-bis-[1-(4-methoxyphenyl)-1-(4-pyrolydinophenyl)ethylene-2-yl]-4,5,6,7-tetrachlorophthalide.

<Others>

3-(4-Diethylamino-2-ethoxyphenyl)-3-(1-ethyl-2-methylindol-3-yl)-4-azaphthalide, 3-(4-diethylamino-2-ethoxyphenyl)-3-(1-octyl-2-methylindol-3-yl)-4-azaphthalide, 3-(4-cyclohexyl ethylamino-2-methoxyphenyl)-3-(1-ethyl-2-methylindol-3-yl)-4-azaphthalide, 3,3-bis(1-ethyl-2-methylindol-3-yl)phthalide, 3,6-bis(diethylamino)fluorane-γ-(3'-nitroanilinolactam, 3,6-bis(diethylamino)fluorane-γ-(4'-nitro) anilinolactam, 1,1-bis-[2',2',2",2"-tetrakis-(p-dimethylaminophenyl)-ethenyl]-2,2-dinitrilethane, 1,1-bis-[2',2',2",2"-tetrakis-(p-dimethylaminophenyl)-ethenyl]-2-β-naphthylethane, 1,1-bis-[2',2',2",2"-tetrakis-(p-dimethylaminophenyl)-ethenyl]-2,2-diacetylethane and bis-[2,2,2',2'-tetrakis-(p-dimethylaminophenyl)-ethenyl]-methylmalonic acid dimethyl ester.

All of the color development agents well known in the conventional field of pressure sensitive and thermosensitive recording media may be used as the color development agent in a thermosensitive recording material of the present invention. Although the dye is not particularly restricted, activated clay, attapulgite, colloidal silica, inorganic acidic substances such as aluminum silicate and the like, 4,4'-isopropylidene diphenol, 1,1-bis(4-hydroxyphenyl)cyclohexane, 2,2-bis(4-hydroxyphenyl)-4-methylpentane, 4,4'-dihydroxydiphenyl sulfide, hydroquinone monobenzyl ether, benzyl 4-hydroxybenzoate, 4,4'-dihydroxy diphenyl sulfone, 2,4'-dihydroxy diphenyl sulfone, 4-hydroxy-4'-isopropoxy diphenyl sulfone, 4-hydroxy-4'-n-propoxy diphenyl sulfone, bis(3-allyl-4-hydroxyphenyl) sulfone, 4-hydroxy-4'-methyl diphenyl sulfone, 4-hydroxyphenyl-4'-benzyloxyphenyl sulfone, 3,4-dihydroxyphenyl-4'-methyl phenyl sulfone, aminobenzene sulfonamide derivatives described in Japanese Patent Application Public Disclosure No. H08-59603, bis(4-hydroxyphenyl thiomethoxy)methane, 1,5-di(4-hydroxyphenyl thio)-3-oxapentane, butyl bis(p-hydroxyphenyl)acetate, methyl bis(p-hydroxyphenyl)acetate, 1,1-bis(4-hydroxyphenyl)-1-phenyl ethane, 1,4-bis[α-methyl-α-(4'-hydroxyphenyl) ethyl]benzene, 1,3-bis[α-methyl-α-(4'-hydroxyphenyl) ethyl]benzene, di(4-hydroxy-3-methylphenyl) sulfide, 2,2'-thiobis(3-tert-octylphenol), 2,2'-thiobis(4-tert-octylphenol), phenolic compounds such as diphenyl sulfone crosslinked compounds and the like described in International Publication WO97/16420, phenolic compounds described in International Publication WO02/081229 or Japanese Patent Application Public Disclosure No. 2002-301873, thiourea compounds such as N,N'-di-m-chlorophenyl thiourea and the like, p-chlorobenzoic acid, stearyl gallate, bis[zinc 4-octyloxy carbonylamino]salicylate dihydrate, 4-[2-(p-methoxyphenoxy)ethyloxy]salicylic acid, 4-[3-(p-trisulfonyl)propyloxy]salicylic acid, aromatic carboxylic acids such as 5-[p-(2-p-methoxyphenoxyethoxy)cumyl]salicylic acid and salts of these aromatic carboxylic acids and polyvalent metals such as zinc, magnesium, aluminum, calcium, titanium, manganese, tin, nickel and the like, and, furthermore, antipirin complexes of zinc thiocyanate and complex zinc salts and the like of terephthal aldehyde acid with other aromatic carboxylic acids, for example, may be cited. These color development agents may be used individually and in mixtures of at least two. The diphenylsulfone crosslinked type compound described in International Publication WO97/16420 is available under the trade name of D-90 produced by Japan Soda K.K. The compound described in International Publication WO02/081229 is also available under the trade names of D-102 and D-100 produced by Japan Soda K.K. In addition, high molecular weight aliphatic acid metal complex salts described in Japanese Patent Application Public Disclosure No. H10-258577 and metal chelate type color development components such as polyvalent hydroxy aromatic compounds and the like may also be present.

The previously well known sensitizers may be used as the sensitizer in the thermosensitive recording medium of the present invention. As such sensitizers, aliphatic acid amides such as stearic acid amide, palmitic acid amide and the like, ethylene bis-amide, montan acid wax, polyethylene wax, 1,2-di-(3-methylphenoxy)ethane, p-benzyl biphenyl, β-benzyloxy naphthalene, 4-biphenyl-p-tolyl ether, m-terphenyl, 1,2-diphenoxyethane, dibenzyl oxalate, di(p-chlorobenzyl) oxalate, di(p-methylbenzyl) oxalate, dibenzyl terephthalate, benzyl p-benzyloxy benzoate, di-p-tolyl carbonate, phenyl-α-naphthyl carbonate, 1,4-diethoxynaphthalen, 1-hydroxy-2-naphthoic acid phenyl ester, o-xylene-bis-(phenyl ether), 4-(m-methyl phenoxymethyl) biphenyl, 4,4'-ethylene dioxy-bis-benzoic acid dibenzyl ester, dibenzoyloxy methane, 1,2-di(3-methylphenoxy)ethylene, bis[2-(4-methoxy-phenoxy) ethyl]ether, methyl p-nitrobenzoate and phenyl p-toluene sulfonate may be listed as examples, but the sensitizer is not particularly limited to these examples. These sensitizers may be used individually and as mixtures of at least two of them.

Pigments, lubricants, stabilizers, crosslinking agents and the like may be used in the thermosensitive recording layer of the present invention in addition to the dye, color developing agents, resin containing carboxyl groups, epichlorohydrin resins and polyamine/amide resins.

As the pigment used in the present invention, inorganic or organic fillers and the like such as silica, calcium carbonate, kaolin, calcined kaolin, diatomaceous earth, talc, titanium oxide, aluminum hydroxide and the like may be cited.

Fatty acid metal salts such as zinc stearate, calcium stearate and the like, wax, silicone resins and the like may be cited as the lubricant used in the present invention.

Crosslinking agents such as polyimine type resins, methylol melamine, melamine formaldehyde resins, potassium persulfate, ammonium persulfate, sodium persulfate, ferric chloride, magnesium chloride, boron sand, boric acid, alum, ammonium chloride and the like may also be used in the present invention in combination in ranges that do not interfere with the desired effects for the tasks described above. 4,4'-Butylidene (6-t-butyl-3-methylphenol), (2,2'-di-t-butyl-5,5'-dimethyl-4,4'-sulfonyl diphenol, 1,1,3-tris(2-methyl-4-hydroxy-5-cyclohexylphenyl) butane, 1,1,3-tris(2-methyl-4-hydroxy-5-t-butylphenyl) butane, 4-benzyloxy-4'-(2,3-epoxy-2-methylpropoxy) diphenyl sulfone and the like may be added as image stabilizing agents in order to yield oil resistance in recorded images.

In addition, benzophenone type and triazole type ultraviolet ray absorbing agents, dispersion agents, de-foaming agents, oxidation inhibitors, fluorescent dyes and the like may be used.

The types and amounts of the electron donating leuco dye, electron receiving color developing agents and other various ingredients used in the thermosensitive recording medium of the present invention are determined according to the required performance and printability and are not particularly restricted. However, from about 0.5 parts to 10 parts of an electron receiving color developing agent, from about 0.5 parts to 10 parts of a sensitizer and about 0.5 parts to 10 parts of a pigment are ordinarily used per 1 part of electron donating leuco dye.

A target thermosensitive recording medium is obtained by applying a coating solution comprising the composition described above on an optional support material such as paper, recycled paper, synthetic paper, film, plastic film, plastic foam film, non-woven cloth and the like. In addition, a composite sheet combining these support materials may also be used as the support material.

The electron donating leuco dye, electron receiving color developing agents and materials added when needed are finely ground into particles, several microns or smaller in size, using a grinder or a suitable emulsification device such as a ball mill, attriter, sand grinder and the like, and a coating solution is prepared by adding a binder and various additive materials depending on the objective. The means by which the coating solution is applied is not particularly restricted, and a commonly used technology may be used. For example, off-machine and on-machine devices equipped with various coaters such as air knife coaters, rod blade coaters, bent blade coaters, bevel blade coaters, roller coaters, curtain coaters, spray coaters and the like may be appropriately selected. The coating amount for a thermosensitive recording layer is not particularly limited and is ordinarily in the range of from 2 $g/m^2$ to 12 $g/m^2$ in terms of dry weight.

The installation of an undercoating layer comprising a polymeric substance containing a filler and the like under the thermosensitive recording layer is desirable for the purpose of enhancing the color developing sensitivity in the thermosensitive recording medium of the present invention. The undercoating layer preferably contains at least one component selected from resin containing carboxyl groups, epichlorohydrin resins and polyamine/amide resins to improve the adhesion to the thermosensitive recording layer.

In addition, a back coating layer can be installed on the support medium surface opposite the surface on which is applied a thermosensitive recording layer to correct the curl. In addition, a variety of well known techniques used in the thermosensitive recording media field such as, for example, super calendar smoothing treatments and the like after individual layers are applied can be appropriately applied.

The thermosensitive recording medium of the present invention can be printed using a publicly known method. Thermal energy released from a thermal head containing a heat generating resistor is ordinarily used to activate the thermosensitive recording medium to develop color. The thermal head is ordinarily activated and controlled in multiple numbers of time division blocks, and desired letters and the like are printed on a thermosensitive recording paper by moving thermosensitive recording paper.

The thermosensitive recording paper of the present invention features good color development sensitivity even when it is printed using a low applied energy of from 0.1 mJ/dot to 0.3 mJ/dot, particularly from 0.2 mJ/dot to 0.3 mJ/dot. Handy terminal printers, POS printers, miniature label printers and the like are methods executed using low energy printing. Now, the applied energy is expressed in terms of the energy applied to one heat generating element (one dot) in a thermal head and is represented by the product obtained by multiplying the power consumed by a head by the time over which the power is consumed.

EXAMPLES

The following Examples illustrate the present invention but the Examples are not intended to limit the scope of the present invention.

Now, in the Examples and Comparative Examples below, an undercoating layer, a thermosensitive color developing layer and an optional protective layer were installed in this order on one side of a supporting medium.

In the explanation, parts and % indicate parts by weight and % by weight, respectively. The coatings used in individual coating layers in thermosensitive recording media were prepared as described below.

[Undercoating Layer Coating Solution]

| | |
|---|---|
| Calcined kaolin (BASF Co. Ansilex 90) | 90 parts |
| 10% Carboxy modified poly(vinyl alcohol) solution (Kuraray Co., Ltd.: PVA-KL318) | 10 parts |
| Styrene-butadiene copolymer latex (solid content: 50%) | 10.0 parts |
| 46% modified polyamide resin (Sumitomo Chemical Co., Ltd.: Sumirez Resin SPI-106N) | 2.0 parts |
| 25% Polyamide epichlorohydrin (Seiko PMC: WS4020) | 1.3 parts |
| Water | 50.0 parts |

The mixture comprising the composition described above was blended and agitated to prepare an undercoating layer coating solution.

[Thermosensitive Color Developing Layer Coating Solution]

The solutions A through C were separately wet ground until the average particle size was about 1 μm.

Solution A (Color Development Agent Dispersion)

| | |
|---|---|
| 4-Hydroxy-4'-isopropoxy diphenyl sulfone (Nippon Soda Co., Ltd.: D8) | 6.0 parts |
| 10% Aqueous solution of poly(vinyl alcohol) | 5.0 parts |
| Water | 1.5 parts |

Solution B (Dye Dispersion)

| | |
|---|---|
| 3-Dibutylamino-6-methyl-7-anilinofluorane (by Yamamoto Kagaku Co.: ODB-2) | 6.0 parts |
| 10% Aqueous solution of poly(vinyl alcohol) | 5.0 parts |
| Water | 1.5 parts |

Solution C (Sensitizer Dispersion)

| | |
|---|---|
| 1,2-bis(2-Methylphenoxy) ethane (Sanko K.K.: KS232) | 6.0 parts |
| 10% Aqueous solution of poly(vinyl alcohol) | 5.0 parts |
| Water | 1.5 parts |

Next the dispersions were blended in the proportion described below to prepare a coating solution for a thermosensitive recording layer.

Thermosensitive Color Developing Layer Coating Solution 1

| | |
|---|---|
| Solution A (50% color development agent dispersion) | 30.0 parts |
| Solution B (50% dye dispersion) | 15.0 parts |
| Solution C (50% sensitizer dispersion) | 30.0 parts |
| 25% Silica dispersion (Mizusawa Industrial Chemicals, Ltd.: P527) | 40.0 parts |
| 10% Carboxyl modified poly(vinyl alcohol) solution (Kuraray Co., Ltd.: PVA-KL318) | 37.5 parts |

-continued

| | |
|---|---|
| 45% Modified polyamide resin (Sumitomo Chemical Co., Ltd..: Sumirez Resin SPI-106N) | 2.5 parts |
| 25% Polyamide epichlorohydrin (Seiko PMC: WS4020) | 5.0 parts |
| 30% Zinc stearate dispersion (Chukyo Yushi Co., Ltd.: HydrinZ-7-30) | 7.5 parts |

Thermosensitive Color Developing Layer Coating Solution 2

| | |
|---|---|
| Solution A (50% color development agent dispersion) | 30.0 parts |
| Solution B (50% dye dispersion) | 15.0 parts |
| Solution C (50% sensitizer dispersion) | 30.0 parts |
| 25% Silica dispersion (Mizusawa Industrial Chemicals, Ltd.,: P527) | 40.0 parts |
| 10% Poly(vinyl alcohol) solution (Kuraray Co., Ltd.: PVA-117) | 37.5 parts |
| 40% Glyoxal solution (Mitsui Toatsu Chemical) | 5.0 parts |
| 30% Zinc stearate dispersion (Chukyo Yushi Co., Ltd.: HydrinZ-7-30) | 7.5 parts |

Thermosensitive Color Developing Layer Coating Solution 3

| | |
|---|---|
| Solution A (50% color development agent dispersion) | 30.0 parts |
| Solution B (50% dye dispersion) | 15.0 parts |
| Solution C (50% sensitizer dispersion) | 30.0 parts |
| 25% Silica dispersion (Mizusawa Industrial Chemicals, Ltd.: P527) | 40.0 parts |
| 20% Acryl emulsion solution (Mitsui Chemicals, Inc.: Barrierstar B2000) | 19.0 parts |
| 40% Glyoxal solution (Mitsui Tbatsu Chemical) | 5.0 parts |
| 30% Zinc stearate dispersion (Chukyo Yushi Co., Ltd.: HydrinZ-7-30) | 7.5 parts |

[Protective Layer Coating Solution]

A protective layer coating solution was prepared next by mixing the following ingredients in the proportion described below.

| | |
|---|---|
| 50% Aluminum hydroxide dispersion (Martinsberg: Martifin OL) | 9.0 parts |
| 10% Carboxyl modified poly(vinyl alcohol) (Kuraray Co., Ltd.: PVA-KL318) | 30.0 parts |
| 30% Zinc stearate dispersion (Chukyo Yushi Co., Ltd.: HydrinZ-7-30) | 2.0 parts |
| 25% Polyamide epichlorohydrin (Seiko PMC; WS4020) | 4.0 parts |
| 45% Modified polyamide resin (Sumitomo Chemical Co., Ltd.: Sumirez Resin SPI-106N) | 2.2 parts |

Example 1

An undercoating layer coating solution was applied using a Mayer bar to a free paper (support material) with 47 g/m$^2$ of basic weight and was dried for 1 min. in a forced air dryer maintained at 120° C. The coating amount obtained from weight difference in the undercoated paper was 8 g/m$^2$. The thermosensitive color developing layer coating solution 1 was applied on the undercoated paper using a Mayer bar and dried for t2 min. using a forced air dryer maintained at 60° C. to prepare a thermosensitive recording medium. The coating amount obtained from the weight difference was 5.1 g/m$^2$.

Example 2

A thermosensitive recording medium was prepared in the same manner described in Example 1 using a 45% modified polyamine resin (Sumitomo Chemical Co., Ltd.: Sumirez resin SPI-102A) in place of the 45% modified polyamide resin in the thermosensitive color developing layer coating solution 1.

Example 3

A thermosensitive recording medium was prepared in the same manner described in Example 1 with the exception of using 0.25 parts of 45% modified polyamide resin (Sumitomo Chemical Co., Ltd.: Sumirez resin SPI-106N) and 0.5 parts of 25% polyamide epichlorohydrin (Seiko FMC: WS4020) in the thermosensitive color developing layer coating solution 1.

Comparative Example 1

A thermosensitive recording medium was prepared in the same manner described in Example 1 without using the 45% modified polyamide resin in the thermosensitive color developing layer coating solution 1.

Comparative Example 2

A thermosensitive recording medium was prepared in the same manner described in Example 1 using the thermosensitive color developing layer coating solution 2 in place of the thermosensitive color developing layer coating solution 1.

Comparative Example 3

A thermosensitive recording medium was prepared in the same manner described in Example 1 using the thermosensitive color developing layer coating solution 3 in place of the thermosensitive color developing layer coating solution 1.

Comparative Example 4

A thermosensitive recording medium was prepared in the same manner described in Example 1 with the exception of using 10% poly(vinyl alcohol) solution (Kuraray Co., Ltd.: PVA-117) in place of 10% carboxyl modified poly(vinyl alcohol) solution (PVA-KL318) in the thermosensitive color developing layer coating solution 1.

Comparative Example 5

A thermosensitive recording medium was prepared in the same manner described in Example 1 with the exception of using 40% glyoxal solution (Mitsui Toatsu Chemical) in place of 25% polyamide epichlorohydrin (Seiko PMC: WS4020) in the thermosensitive color developing layer coating solution 1.

Comparative Example 6

A thermosensitive recording medium was prepared in the same manner described in Example 1 with the exception of not using 45% modified polyamide resin (Sumitomo Chemical Co., Ltd.: Sumirez resin SPI-106N) and 25% polyamide epichlorohydrin (Seiko PMC: WS4020) in the thermosensitive color developing layer coating solution 1. Furthermore, the protective layer coating solution was applied using a Mayer bar on a thermosensitive color developing layer and was dried for 2 min. using a forced air dryer maintained at 60° C. The coating amount of the protective layer obtained from the weight difference was 3.0 g/m$^2$.

The thermosensitive recording media obtained were evaluated as described below.

<Color Development Sensitivity>

A thermosensitive recording medium print tester (Ohkura Engineering Co., Ltd. TH-PMD equipped with a thermal head by Kyosera Co.) was used to print at applied energy of 0.23 mJ/dot, 0.35 mJ/dot and 0.41 mJ/dot. The color development sensitivity of the printed section was measured using a Macbeth Densitometer (RD-914)<

<Resistance for Background Coloring>

The thermosensitive recording medium was left standing for 24 hours at 50° C. and 90% RH and the base was evaluated using Macbeth intensity.

<Plasticizer Resistance>

A paper tube was wrapped once with poly(vinyl chloride) wrap (Mitsui Tbatsu Chemical: High Wrap KMA), and a thermosensitive recording medium that had been printed using the printer TH-PMD (0.23 mJ/dot) was applied. Furthermore, the tube was wrapped 3 times with poly(vinyl chloride) wrap and was left standing for 24 hours at 23° C. The Macbeth intensity of the printed section was measured.

<Wet Rubbing>

A finger was dipped in tap water and was used to rub the surface coated with the thermosensitive color developing layer coating solution 50 times back and forth. The peeling of the coating layer was visually evaluated according to the following standards.

| | |
|---|---|
| Good: | Almost no peeling of the coating layer |
| Fair: | Slight peeling of the coating layer |
| Poor: | Majority of the coating layer peeled |

<Wet Blocking Resistance>

A total of 10 ml of tap water was added dropwise to the surface coated with the thermosensitive color developing layer coating solution, and the coated surface was stacked facing the wet surface, and the stack was left standing for 24 hours under a 10 g/cm$^2$ load. Then the stack was separated, and the coated layer was visually evaluated for peeling in the area where the water was added dropwise according to the following standards.

| | |
|---|---|
| Good: | Almost no peeling of the coating layer |
| Fair: | Slight peeling of the coating layer |
| Poor: | Majority of the coating layer peeled |

<Wet Sticking Resistance>

A thermosensitive recording medium was immersed in water for 3 min. and was folded in two so that the recording surface was inside. The folded medium was placed under a 300 g/cm$^2$ load and was unfolded while the recording surface was damp. The recording surface was allowed to develop color for 2 min. at 105° C., and the extent of peeling on the recording surface was visually evaluated according to the following standards.

| | |
|---|---|
| Good: | No peeling of the recording layer |
| Fair: | Slight peeling of the recording layer |
| Poor: | Extensive peeling of the recording layer |

The evaluation results are shown in Table 1. The numbers in the color development sensitivity column in Table 1 indicate the applied energy in the tester used for printing.

Based on the data shown in Table 1 the thermosensitive recording media of the present invention exhibited good color development sensitivity, storage stability (resistance for background coloring and plasticizer resistance) and water resistance. The color development sensitivity was excellent even when low applied energy (0.23 mJ/dot) was used for printing.

TABLE 1

| | Color development sensitivity | | | Storage stability | | | | |
|---|---|---|---|---|---|---|---|---|
| | 0.23 mJ/dot | 0.35 mJ/dot | 0.41 mJ/dot | Resistance for background coloring | Plasticizer resistance | Water resistance | | |
| | | | | | | Wet rubbing | Wet blocking | Wet sticking |
| Example 1 | 1.07 | 1.36 | 1.32 | 0.04 | 0.68 | Good | Good | Good |
| Example 2 | 1.09 | 1.36 | 1.31 | 0.04 | 0.67 | Good | Good | Good |
| Example 3 | 1.08 | 1.37 | 1.33 | 0.04 | 0.69 | Good | Good | Good~Fair |
| Comparative Example 1 | 1.05 | 1.36 | 1.31 | 0.05 | 0.52 | Fair | Fair | Poor |
| Comparative Example 2 | 0.98 | 1.34 | 1.28 | 0.04 | 0.48 | Good | Fair | Fair |
| Comparative Example 3 | 1.03 | 1.35 | 1.30 | 0.08 | 0.12 | Fair | Fair | Fair~Poor |
| Comparative Example 4 | 1.02 | 1.33 | 1.27 | 0.04 | 0.63 | Poor | Fair~Poor | Poor |
| Comparative Example 5 | 0.95 | 1.26 | 1.19 | 0.05 | 0.45 | Fair | Fair | Fair |
| Comparative Example 6 | 0.23 | 1.14 | 1.45 | 0.04 | 0.23 | Good | Good | Good |

What is claimed is:

1. A thermosensitive recording medium having a thermosensitive recording layer comprising a colorless or pale colored basic leuco dye and an electron accepting developing agent on a substrate, wherein the thermosensitive recording layer further comprises as three distinct resins, a resin containing a carboxyl group, an epichlorohydrin resin and a polyamine/amide resin.

2. The thermosensitive recording medium of claim 1, wherein the resin containing a carboxyl group is carboxy modified polyvinylalcohol.

3. The thermosensitive recording medium of claim 1 or 2, wherein the thermosensitive recording medium does not have a protecting layer on the thermosensitive recording layer.

4. The thermosensitive recording medium of any one of claims 1 to 2, wherein the thermosensitive recording medium is recorded with an applied energy of 0.1 to 0.3 mJ/dot.

5. A method for preparing a recorded thermosensitive recording medium comprising recording the thermosensitive recording medium of any one of claims 1 to 2 with an applied energy of 0.1 to 0.3 mJ/dot.

* * * * *